United States Patent [19]

Schnell

[11] Patent Number: 4,884,801

[45] Date of Patent: Dec. 5, 1989

[54] LOAD APPLYING DRIVING APPARATUS FOR AN EXERCISE DEVICE

[76] Inventor: Josef Schnell, Sportweg 9, Ortsteil Peutenhausen, 8899 Gachenbach, Fed. Rep. of Germany

[21] Appl. No.: 264,197

[22] Filed: Oct. 28, 1988

[30] Foreign Application Priority Data

Nov. 9, 1987 [DE] Fed. Rep. of Germany ..... 3737980

[51] Int. Cl.[4] ..... A63B 21/00

[52] U.S. Cl. ..... 272/117; 272/129; 272/134

[58] Field of Search ..... 272/117, 118, 129, 130, 272/134; 73/380, 381

[56] References Cited

U.S. PATENT DOCUMENTS

| | | | |
|---|---|---|---|
| 3,397,884 | 8/1968 | Blasi | 73/380 X |
| 3,627,315 | 12/1971 | Marcyan | 272/118 |
| 3,820,782 | 6/1974 | Salkeld | 272/118 |
| 3,856,297 | 12/1974 | Schnell | 272/117 X |
| 4,546,970 | 10/1985 | Mahnke | 272/134 X |
| 4,635,933 | 1/1987 | Schnell | 272/129 |
| 4,666,149 | 5/1987 | Olschansky et al. | 272/134 X |
| 4,741,530 | 5/1988 | Wolf | 272/129 X |
| 4,763,897 | 8/1988 | Yakata | 272/118 |

FOREIGN PATENT DOCUMENTS

| | | | |
|---|---|---|---|
| 3445104 | 6/1986 | Fed. Rep. of Germany | 272/118 |

*Primary Examiner*—Richard J. Apley
*Assistant Examiner*—Robert W. Bahr
*Attorney, Agent, or Firm*—Henry M. Feiereisen

[57] ABSTRACT

A load applying driving apparatus for an exercise device of any kind includes a motor providing a counterforce, a crank mechanism operatively connected to the motor and a flexible transmission member for transmitting the counterforce from the motor via the crank mechanism to a user-actuated member of the exercise device. Upon exercise, the motor exerts a load on the user-acutated member when the user carries out the lifting stroke and the return stroke.

24 Claims, 4 Drawing Sheets

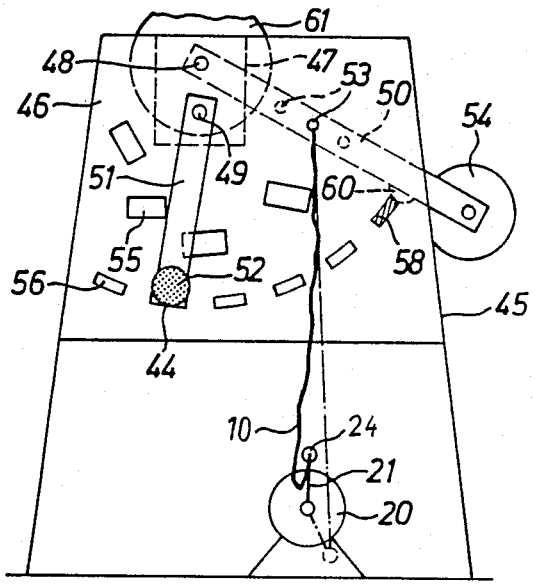
Fig. 5
Fig. 7
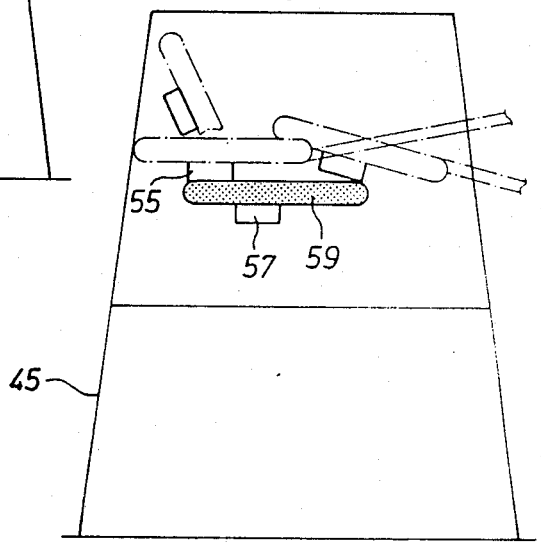
Fig. 6
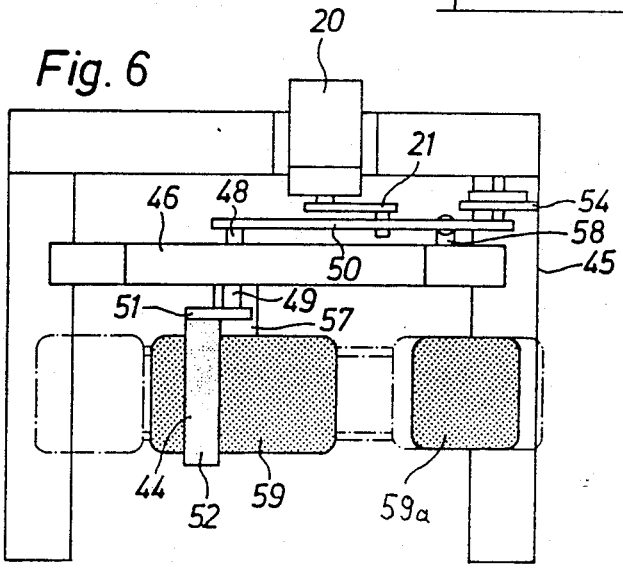

LOAD APPLYING DRIVING APPARATUS FOR AN EXERCISE DEVICE

BACKGROUND OF THE INVENTION

The present invention refers to a load applying driving apparatus for an exercise device.

In recent times, exercise devices have found importance not only for athletic purposes but also for workout and rehabilitation. The market has thus been flooded with all kinds of exercise devices which in general, however, do not pay enough attention to the fact that during negative contraction i.e. return stroke, a muscle develops more tension at same stimulus or effort than during positive contraction i.e. lifting stroke. This lack of attention is based on the thinking that once a weight has been lifted, it cannot be made heavier during the return stroke. Thus, negative exercise remains insufficient although it should enjoy priority. Similar conditions exist in motor-driven devices in which the force of the motor is transmitted via a crank and a connecting rod to the respective device.

SUMMARY OF THE INVENTION

It is an object of the present invention to provide a load applying driving apparatus for an exercise device for imposing a counterforce upon exercise of muscles during a lifting stroke and during a return stroke.

This object and others which will become apparent hereinafter are attained in accordance with the present invention by providing a motor which generates the counterforce, a crank mechanism operatively connected to the motor, and a flexible transmission member for transmitting the counterforce from the motor via the crank mechanism to a user-actuated member of the exercise device so that the motor exerts upon exercise a counterforce on the user-actuated member during a lifting stroke and during a return stroke.

The transmission member may be any flexible element which transmits a force only at tensile load such as e.g. a belt, rope or chain. The crank mechanism includes a crank which is operatively connected to the motor so as to perform complete revolutions and thus allowing a tightening and loosening of the belt. Thus, an exercise device equipped with a load applying driving apparatus according to the invention does not necessarily require additional weights as the motor may provide the required "weight force" during the lifting stroke and during the return stroke.

As the user performs the upward stroke and the motor is turned on by a suitable switch either by hand or by foot, the crank will transmit a force via the tightened belt on the user-actuated member so as to provide a load or force during the downward stroke. In case, e.g. weight plates are used with the exercise device, the force exerted by the motor will be effective in addition to the gravity force by the weight plates.

Thus, through the driving apparatus in accordance with the invention, the user can select or adapt the exercise to his or her abilities and intentions by respectively controlling the motor.

According to a further feature of the invention, the one end of the transmission member remote to the motor is connected to a weight arm of an input shaft at one side of a gearbox which has an output shaft at the other side of the gearbox to support the user-actuated member or training arm. Alternatively, the training arm or the input shaft may support a disk such as a pulley to which the one end of the transmission member may be selectively attached via suitable fasteners. Such a driving apparatus is especially suitable for a multi-exercise device as shown in the inventor's own patent application Ser. No. 067,620.

Instead of using a pulley, the one end of the transmission member which end is remote to the motor may also be selectively attached and guided by adjustable bolts to at least one apertured disk, preferably, however, to two spaced identical apertured disks, such as e.g. shown in U.S. Pat. No. 4,709,920 of the inventor.

The use of a driving apparatus according to the invention is, however, not limited to exercise devices in which the lifting stroke is effected through rotational movement of the user-actuated member or training arm but is also applicable to rectilinear movement.

In the event, it is desired to use only small driving motors or small gearmotors, the use of weights in addition to the motor force is preferred such as e.g. exchangeable weights connected to the weight arm of the gear shaft or a stack of weight plates which are directly or indirectly connected to the training arm. By using additional weights, the transmission member can be kept under slight tension in many positions so that a hard engaging of the motor in one motion is essentially avoided. Certainly, concussion springs limiting the extension could be used to counter the hard engagement.

Known exercise devices require expensive measuring instruments in order to determine the performance of the user. Advantageously, the present invention allows the use of an inexpensive tension measuring element such as a spring scale contained in the transmission member to measure the power or performance of the user in case the effective lever arms between the mounting of the one end of the transmission member remote to the motor and the respective axis of the training arm are not altered.

In the event the angular path or the rectilinear path of the transmission member should be modified, extended or shortened, the present invention proposes to provide the crank of the crank mechanism with a rolling surface over which the transmission member runs, with one end thereof being fastened to a support which is attached to a swivel arm so as to be swingable along a curve, preferably along an arc of a circle. The swivel arm is pivoted to a protective plate or protective wall via T-screws extending through arched slots of the plate.

The positional relationship of the crank and the support is such that the support is located outside the circular movement of the crank. By swinging the support along the curve, the effective length of the transmission member can be controlled in a simple manner with superior operational safety and long life. Certainly, the effective length of the transmission member may be attained also by other means such as e.g. by using a take-up reel for the transmission member or by overlapping parts of the transmission member.

Preferably, a deflection roller which is swingable along a curve is arranged between the crank and the user-actuated member about which the transmission member is guided in order to allow a variation of the path of the transmission member. The deflection roller is mounted on a swivel arm which is fixed to the protective plate by means of T-screws extending through arched slots of the plate so that the user can easily adjust or swing the deflection roller when desired.

BRIEF DESCRIPTION OF THE DRAWING

The above and other objects, features and advantages of the present invention will now be described in more detail with reference to the accompanying drawing in which:

FIG. 5 is a side view of an exemplified multi-exercise device equipped with a driving apparatus in accordance with the invention;

FIG. 6 is a top view of the multi-exercise device;

FIG. 7 is the other side view of the multi-exercising device of FIG. 5 and illustrating various positions of the support for a user;

DETAILED DESCRIPTION OF PREFERRED EMBODIMENTS

Figure 1:
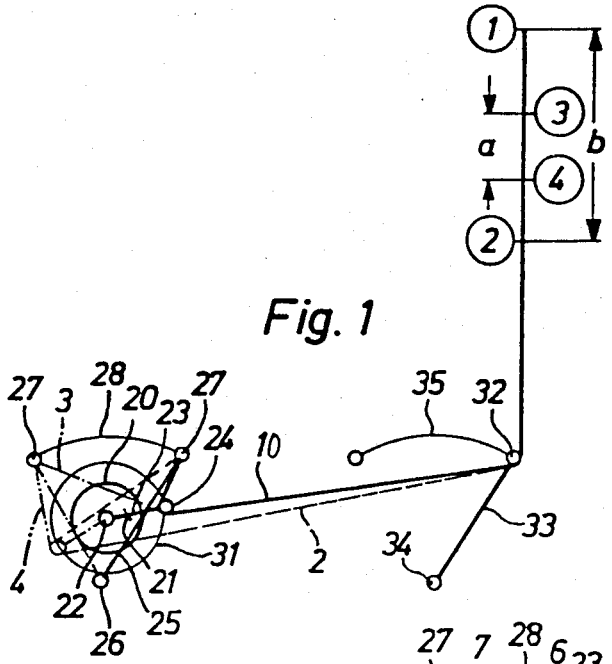
FIG. 1 is principal schematic illustration of one embodiment of a load applying driving apparatus in accordance with the invention.
Figure 2:
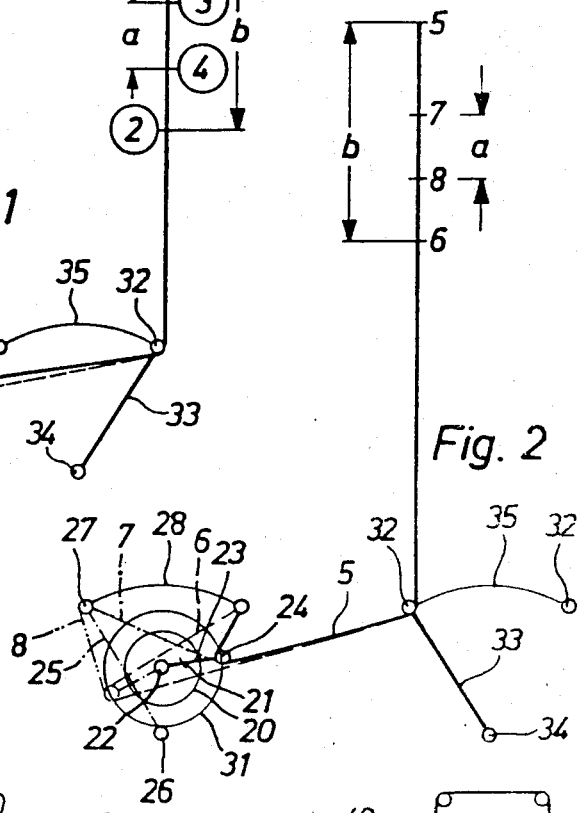
FIG. 2 is a schematic illustration of the driving apparatus of FIG. 1 in a different operational position.
Figure 3:
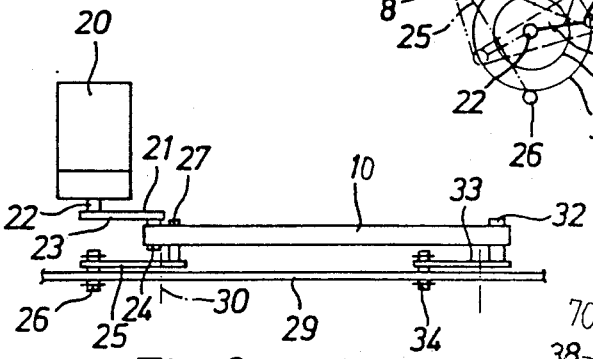
FIG. 3 is a top view of the driving apparatus of FIG. 1.

Referring firstly to FIGS. 1 to 3, there is shown a principal schematic illustration of a driving apparatus in accordance with the invention which can be added to a exercise device of any type. The driving apparatus includes a driving motor 20 which may be a gearmotor or any other suitable motor and depending on the type of exercise is actuated by hand or foot via a suitably located switch (not shown). The motor 20 is operatively connected to a crank mechanism which is generally designated by reference numeral 21 and includes a lever 23 connected at one axial end thereof to an axle or shaft 22. The shaft 22 simultaneously represents the motor shaft. The other axial end of the lever 23 supports the actual crank 24.

The driving apparatus further includes a swivel arm 25 which is supported with one end thereof by a stationary protective plate 29 as shown at 26. The swivel arm 25 carries at the other free end thereof a support 27 which is connected to the protective plate 29 as indicated at 30 in FIG. 3 and is manually and continuously adjustable along a slot-like curve 28 in the plate 29 e.g. via T-screws which project through the curve 28. As illustrated in particular in FIG. 1, the relationship of all elements of the driving apparatus is such that the crank 24 is freely rotatable relative to the support 27 along an arc of a circle 31.

Attached to the support 27 is one end of a flexible transmission member 10 such as a belt. Certainly, the transmission member 10 may also be a chain or rope or the like. The belt 10 is guided over the roller-type crank 24 and runs about a deflection roller 32 which is arranged at a distance to the crank 24 and is supported at one end of a swivel arm 33. The other end of the swivel arm 33 is swingably mounted at 34 to the plate 29. As shown in particular in FIG. 1, the swivel arm 33 is swingable along a slot-like curve 35 in the plate 29 so as to adjust the position of the deflection roller 32. The adjustment and fixation of the swivel arm 33 is attained by T-screws which project through the curve 35.

The other end of the belt 10 remote to the support 27 is fixed to a suitable part of an exercise device as indicated by the encircled numeral 1 in FIG. 1. When the crank mechanism 21 is actuated and the actual crank 24 rotates e.g. in clockwise direction, the belt 10 runs along a path as indicated by the broken line 2 from roller 32 via crank 24 to support 27, with the end of the belt 10 now being at a position corresponding to the encircled numeral 2. Thus, the belt 10 covers a distance b.

In case the support 27 is swung to the left along the curve 28, the path of the belt 10 between the support 27 and the crank 24 is extended as indicated by dash-dot line 3 so that the end of the belt 10 is now at a position corresponding to the encircled numeral 3, with the crank mechanism 21 and thus the crank 24 not yet changing the position. As the motor is turned on by the user, the crank 24 rotates in clockwise direction and the belt 10 extends between roller 32 and crank 24 as indicated by broken line 2 and between the crank 24 and the support 27 as indicated by dash-dot-dot line 4, with the end of the belt 10 now being at a position corresponding to the encircled numeral 4. The belt 10 now covers a distance a, thus illustrating the modification of the effective length of the belt 10..

When the deflection roller 32 is swung to the left, as shown in FIG. 2, it will readily be recognized that the distances a, b as described with reference to FIG. 1 are essentially the same as illustrated by the markings 5, 6, 7, 8. The only difference resides in the fact that the distance between the crank 24 and the deflection roller 32 is reduced, thus allowing the belt 10 to run at a different position.

Figure 4:
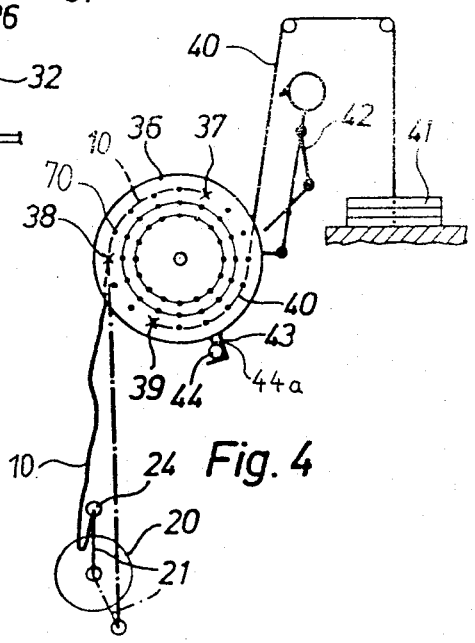
FIG. 4 is a schematic illustration of an exemplified application of a driving apparatus according to the invention in connection with an exercise device.

Turning now to FIG. 4, there is shown a non-limiting example of an exercise device equipped with a load applying driving apparatus according to the invention. As will be readily recognized, the driving apparatus in FIG. 4 is provided without the adjustable deflection roller 32. Instead, desired angular variations and positional variations are attained through an apertured disk 36 which includes a plurality of arcuately displaced openings 70 along circles. It will be appreciated that it is certainly possible to provide two such disks 36 parallel at a distance to each other. Insertable in the openings 70 are bolts 37 to allow suitable attachment and guidance of the belt 10 along an arc of a circle. Reference numeral 38 represents the last bolt over which the belt 10 runs. Opposing the direction of the belt 10 is a further belt 40 which is attached to and guided on the disk 36 by bolts 39 and is operatively connected after being twice deflected to a stack of weight plates 41.

Connected to the apertured disk 36 is a training arm 44 with a roller 44*a* which is actuated by a user 42 e.g. with shank 43 of a leg. Although not shown in the drawing, the belt 10 is contained within a protective shell of transparent material to allow the user 42 to see the belt 10 during operation.

Assuming that the user wishes to exercise the legs as schematically indicated in FIG. 4 and the crank 24 is at its upper dead center so that the belt 10 is loose as shown in continuous line, the user 42 starts the exercise by pressing with his or her shank against the roller 44a in clockwise direction in order to lift the weight plates 41. Simultaneously with lifting the weight plates 41, the loose belt 10 is rolled up on the disk 36 and tightened. Once the belt 10 is tightened and the lift stroke is carried out, the user 42 will push with his or her hand a switch which is suitably located on the training arm 44 to start the motor 20. Thus, the crank 24 will rotate from its upper dead center in clockwise direction towards the lower dead center thereby imposing a force in addition to the gravity force of the weight plates 41 when the user 42 carries out the return stroke. The user 42 must restrain a greater force during the return stroke i.e. bending the legs during negative contraction. After the return stroke, the crank 24 passes the lower dead center so that the belt 10 relaxes and the user 42 performs the lift stroke again while the crank rotates toward the upper dead center to complete a cycle. It will be readily recognized that the motor 20—depending on the intentions of the user—may now run continuously until termination of the exercise.

FIG. 4 refers to exercises which require the legs to lift the weight plates 41. In case, the arms are used for lifting the weight plates 41, a switch is conveniently located next to a foot in order to start the motor 20. Otherwise the exercise is carried out in a same manner as previously described.

By equipping an exercise device with a load applying driving apparatus according to the invention, the use of weights may completely be omitted as the force provided by the motor 20 may be solely used as counterforce during the lift stroke as well as during the return stroke. Assuming the belt 10 is in a position as shown in dash-dot line in FIG. 4, with the crank 24 approaching the lower dead end center, the user 42 can now attempt to carry out the lift stroke. Since the belt 10 is tightened, the motor 20 opposes the lifting force applied by the user 42 until reaching the upper dead center at which point the motor provides an additional force for the return stroke. Thus, the motor 20 can be used as "weight" during exercise. The constant adjusting or changing of the weights as required in known exercise devices can thus be avoided. The driving apparatus according to the invention makes it possible for the user 42 to adjust the exercise to his or her abilities because it allows the use of solely the weight plates or solely the motor force or also a combination thereof. The user 42 can control the use of the motor 20 and thus of the crank mechanism 21 by actuating one of the switches conveniently located e.g. on the training arm 44 and next to the foot e.g. at the base of the exercise device.

It will be appreciated that instead of using the disk 36 and changing of the bolts 37, 38 to modify the angular path and position, it is certainly possible to equip the exercise device of FIG. 4 with a driving apparatus in accordance with FIGS. 1 to 3, i.e. the belt 10 travels over a deflection roller 32 in order to alter the angular path and position of travel.

Turning now to FIGS. 5 to 7, there are shown various views of a multi-exercise device 45 of the type as described in the inventor's own patent application Ser. No. 067,620 which multi-exercise device 45 is now, however, equipped with a load applying driving apparatus in accordance with the present invention. The multi-exercise device 45 has a box-like housing member 46 which accommodates a gearbox 47 with an input shaft 48 and an output shaft 49. For ease of illustration, the gearbox 47 is not shown in detail. Both shafts 48, 49 are operatively connected via a pair of gears (not shown) rotatably mounted on the shafts 48, 49. The gears can be brought out of mesh by axially shifting e.g. shaft 49.

The shaft 48 supports at one side of the housing member 46 a weight arm 50 which provides the necessary resistance or counterweight during exercise and is provided at its free end remote to the shaft 48 with a selective number of weights 54. At the other side of the housing member 46, the shaft 49 supports the training arm 44 which is actuated by the user to perform various exercises. The lever of the training arm 44 is designated by reference numeral 51 while the actual user-actuated member such as a padded roller is designated by reference numeral 52. By disengaging the shafts 48, 49, their relative angular positions and thus the angular position of the training arm 44 relative to the weight arm 50 can be modified to allow training of a wide variety of muscle sections.

The housing member 46 is provided with a plurality of openings 55 which are disposed and spaced from each other in such a manner that a support member 59 can be brought into various positions by means of a mounting arm 57 which is selectively insertable in one of the openings 55. FIG. 7 illustrates the various possible positions of the support member 59. The housing member 46 is further provided with a plurality of openings 56 which are spaced from each other along an arc of a circle. Selectively insertable in the openings 56 is a stop member 60 which locks the movement of the weight arm 50 in one direction.

As shown in FIG. 5, the weight arm 50 is provided with apertures 53 for selective attachment of the one end of the belt 10. Located at the base of the housing member 46 is the motor 20 and the crank mechanism 21 which cooperate with the belt 10 as previously described.

Upon exercise with such a modified exercise device, when the user applies a force against the roller 52 in clockwise direction, the weight arm 50 is lifted with its weights 54 so as to tighten the belt 10 which is contained within a protective transparent shell (not shown) to allow the user to monitor the belt 10. When the weight arm 50 is lifted and the belt 10 is tightened, the user actuates the motor 20 via a suitably located switch so that the crank mechanism 21 i.e. crank 24 rotates from the upper dead center towards the lower dead center to provide the additional force during the return stroke. The exercise can be carried out in a same manner as described with reference to the exercise device of FIG. 4.

Instead of attaching the one end of the belt 10 to the weight arm 50, it is also possible to place on the shaft 48 an apertured disk 61 to which the one end of the belt 10 is affixed. FIG. 5 shows the disk 61 in broken line.

Referring now to FIGS. 8-16, there are shown various exercises which can be performed with the modified exercise device 45 in accordance with the invention.

Figure 8:
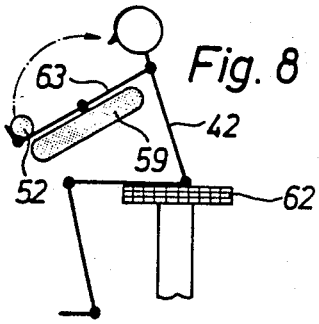
FIGS. 8 to 16 are simplified schematic illustrations of various exercises possible with the multi-exercise device of FIG. 5.
Figure 9:
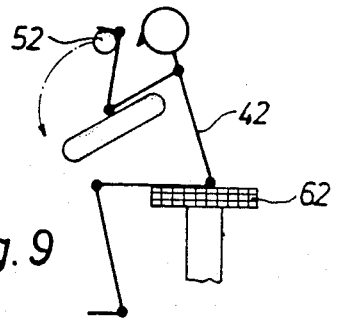
Figure 10:
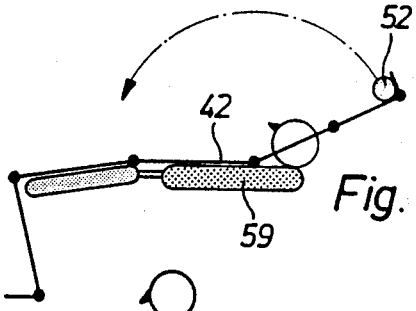
Figure 11:
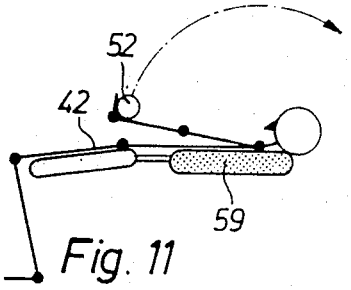
Figure 12:
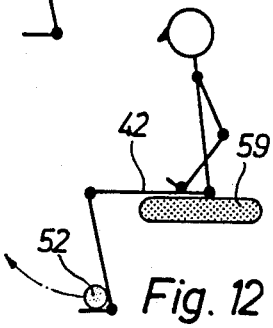

In FIG. 8, the user 42 sits on a seat 62 and his or her arms 63 rest on the support 59. When moving the roller 52 of the training arm 44 in direction of the arrow, the weights 54 (FIG. 5) are lifted to exercise the biceps. Certainly, as already outlined, the weights 54 may be omitted and the motor 20 may be used as "weight" or a combination of weight plates or motor can be used for exercising the biceps. During the return stroke of the training arm 44, the crank mechanism 21 will provide a return force—possibly in addition to the gravity forces of the weight plates 54—which must be restrained by the user 42. FIG. 9 illustrates the exercise of the triceps. The exercises as depicted in FIGS. 10 and 11 are "pull-over" and "arm raise" for training the shoulder muscles. FIG. 12 illustrates the exercise "leg extension", with the user 42 sitting on the support 59 of the exercise device 45 and urging the roller 52 of the training arm 44 in direction of the arrow. During return stroke to the initial position, the motor 20 is again effective via the crank mechanism 21.

Figure 13:
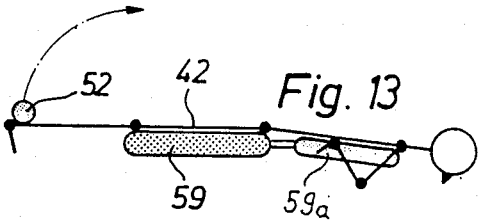

For performing the exercise "thigh curl" as shown in FIG. 13, a slightly downwardly inclined extension bench **59*a* is attached to the support 59, and the user 42 lies on the benches 59 and 59*a* with the face down and with the lower leg parts engaging the roller 52 to move the training arm 44** in direction of the arrow.

Figure 14:
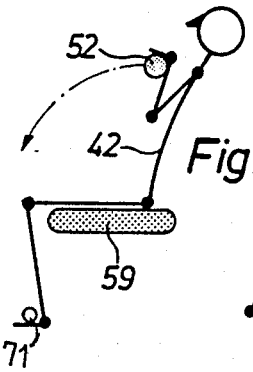
Figure 15:
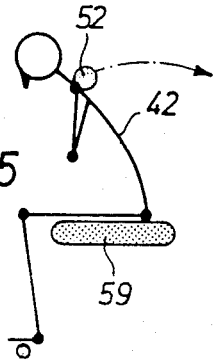

The abdominal muscles and back muscles are exercised in accordance with FIGS. 14 and 15, with the feet of the user bearing against a stationary foot support 71 in order to provide a required resistance during this exercise.

Figure 16:
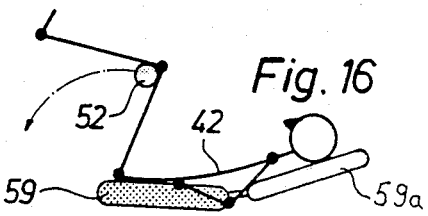

FIG. 16 illustrates the exercise of hip muscles. For support of the head, the extension **59*a* is suitably attached to the support 59. The roller 52** is engaged in the hollow of the knee and urged in direction of the arrow.

Figure 17:
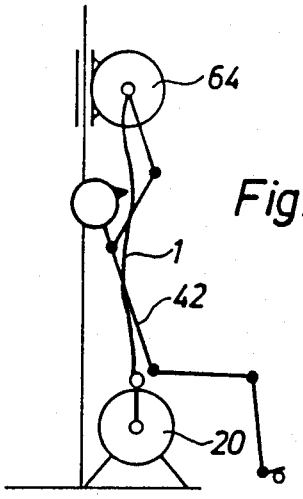
FIG. 17 is a schematic illustration of an exercise device for weight lifters and equipped with a driving apparatus in accordance with the invention.
Figure 18:
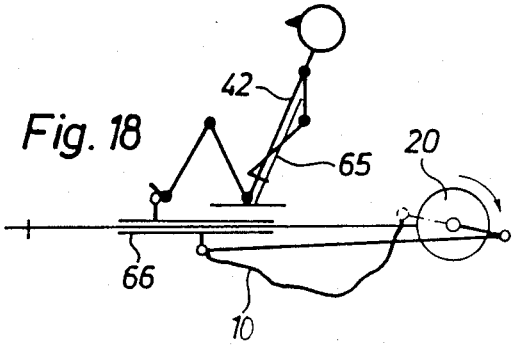
FIG. 18 is a schematic illustration of an exercise device for leg extension equipped with a driving apparatus in accordance with the invention.
Figure 19:
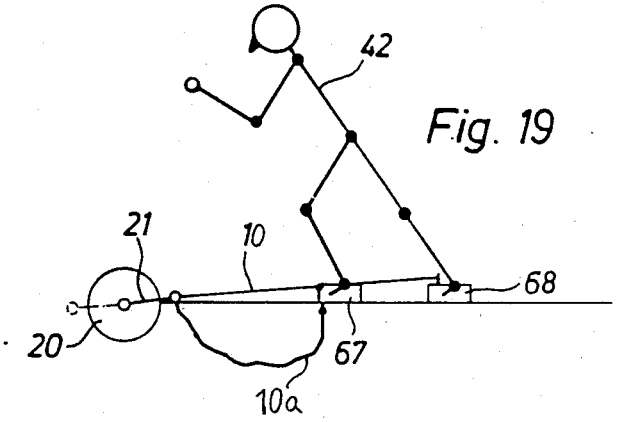
FIG. 19 is a schematic illustration of an exercise device with so-called running belts and equipped with a driving apparatus in accordance with the invention.

The exercise devices as shown in FIGS. 17 to 19 refer to exercises in which the legs or arms are moved in a straight line. Still, the principle of the present invention is applicable also in these instances.

The exercise device according to FIG. 17 includes a vertical and overhead carriage which supports a dumbbell 64 lifted by the user 42 without assistance by the motor 20. When lowering the dumbbell 64, the tightened belt 10 will be pulled by the motor 20 to provide an additional return force. As already described above, this exercise may certainly be carried without dumbbell so that in this case the force exerted by the motor 20 can be used as "weight" to carry out the exercise.

In FIG. 18, the user 42 sits on a seat 65 and pushes a horizontally guided or slantingly guided carriage 66 with the legs to the left. In case the user attempts to push the carriage 66 too fast, the motor 20 will exert a counterforce during the leg extension. During the reverse movement of the carriage 66, the motor 20 applies a counterforce via the belt 10.

FIG. 19 illustrates two starting block-like elements 67, 68 which are actuated by the legs of the user 42. Each of the block elements 67, 68 is connected via belts 10, **10*a* to a crank mechanism 21 of the motor 20**, with the crank mechanisms offset to each other by 180°.

Although the driving apparatus as shown in FIGS. 17 to 19 are not provided with a deflection roller 32 as illustrated in FIGS. 1 to 3, it is certainly possible to such a deflection roller 32 if desired.

While the invention has been illustrated and described as embodied in a load applying driving apparatus for an exercise device, it is not intended to be limited to the details shown since various modifications and structural changes may be made without departing in any way from the spirit of the present invention.

What is claimed as new and desired to be protected by Letters Patent is set forth in the appended claims:

I claim:

1. An exercise device; comprising:

a user-actuated member;

weight means connectable to said user-actuated member for providing resistance during exercise; and driving means acting on said user-actuated member independently of said weight means for exerting a load on said user-actuated member, said driving means including a motor, a crank mechanism operatively connected to said motor and a flexible transmission member connecting said crank mechanism with said user-actuated member for allowing application of the load as exerted by said motor to said user-actuated member, said flexible transmission member being alternately in a loose and tight state during operation of said motor so that said user-actuated member is selectably acted upon by the load of said driving means during a lifting stroke and during a return stroke.

2. An exercise device as defined in claim 1, and further comprising a gear box with an input shaft supporting a weight arm and an output shaft supporting the user-actuated member, said transmission member being operatively connected remote to said motor to the weight arm.

3. An exercise device as defined in claim 1, and further comprising a gear box with an input shaft supporting a weight arm and an output shaft supporting the user-actuated member, and further comprising a disk supported by the weight arm, and fastening means for attaching said transmission member remote to said motor to said disk.

4. An exercise device as defined in claim 12 wherein said disk is a pulley.

5. An exercise device as defined in claim 1, and further comprising at least one apertured disk located on the user-actuated member, and fastening means for selectively attaching said transmission member remote to said motor to said apertured disk.

6. An exercise device as defined in claim 1 wherein the user-actuated member is a vertically guided carriage with a dumbbell rod, said transmission member having one end connected to said carriage and another end operatively connected to said motor via said crank mechanism.

7. An exercise device as defined in claim 1 wherein the user-actuated member is a horizontally guided carriage for allowing exercise of leg extension, said transmission member having one end connected to said carriage and another end operatively connected to said motor via said crank mechanism.

8. An exercise device as defined in claim 1 wherein the user-actuated member is represented by two glider blocks slidably guided parallel to each other in guides, wherein two such transmission members are operatively connected to two crank mechanisms offset to each other by 180°, said transmission members having one end connected to said glider blocks and another end operatively connected to said motor via said crank mechanisms.

9. An exercise device as defined in claim 1 wherein said crank mechanism includes a rotatable crank performing complete revolutions, a lever connected to one end of said crank and a shaft supporting the other end of said lever and connected to said motor.

10. An exercise device as defined in claim 1 wherein said transmission member is a belt.

11. Load applying driving apparatus for imposing a counterforce during exercise on a user-actuated member of an exercise device, comprising:

a motor providing the counterforce;

a crank mechanism operatively connected to said motor;

a flexible transmission member for transmitting the counterforce from said motor via said crank mechanism to the user-actuated member of the exercise device so that said motor exerts a load on the user-actuated member during a lifting stroke and during a return stroke;

a stationary protective plate; and first adjusting means for modifying the effective length of said transmission member, said first adjusting means including a swivel arm having one end swingably mounted to said protective plate and another end, a support connected to said other end of said swivel arm so as to be adjustable along a curve, said transmission member being fastened with its one end to said support and with its other end operatively connectable to the user-actuated member via said crank mechanism.

12. Driving apparatus as defined in claim 11 wherein said crank mechanism includes a rotatable crank performing complete revolutions, a lever connected to one end of said crank and a shaft supporting the other end of said lever and connected to said motor.

13. Driving apparatus as defined in claim 12 wherein said support is arranged outside the circular movement of said crank.

14. Driving apparatus as defined in claim 12 wherein said crank of said crank mechanism is provided with a rotating sliding surface over which said transmission member runs.

15. Driving apparatus as defined in claim 14 wherein said crank is provided with a roller.

16. Driving apparatus as defined in claim 11 wherein said curve is an arc of a circle.

17. Driving apparatus as defined in claim 11, and further comprising second adjusting means for modifying the angular path and the position of the path of said transmission member, said second adjusting means including a deflection roller arranged between said crank mechanism and the user-actuated member and adjustable along a curve.

18. Driving apparatus as defined in claim 17, wherein said second adjusting means includes a swivel arm having one end swingably mounted to said protective plate and another end supporting said deflection roller.

19. Driving apparatus as defined in claim 11 wherein said transmission member is a belt.

20. Driving apparatus as defined in claim 11 wherein said transmission member is a chain.

21. Driving apparatus as defined in claim 11 wherein said transmission member is a rope.

22. Driving apparatus as defined in claim 11, and further comprising weight means operatively connectable to the user-actuated member for providing a load in addition to the counterforce exerted by said motor via said transmission member.

23. Driving apparatus as defined in claim 11, and further comprising tension measuring means for determining the performance of the user, said tension measuring means being provided in said transmission member.

24. Driving apparatus as defined in claim 23 wherein said tension-measuring means is a spring scale.

* * * * *